US006861989B2

(12) United States Patent
Morningstar et al.

(10) Patent No.: US 6,861,989 B2
(45) Date of Patent: Mar. 1, 2005

(54) ANTENNA SYSTEM FOR A COMMUNICATION DEVICE

(75) Inventors: Paul Morningstar, North Lauderdale, FL (US); Vijay L. Asrani, Boynton Beach, FL (US); Amin T. Jalali, Boynton Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/613,682

(22) Filed: Jul. 3, 2003

(65) Prior Publication Data

US 2005/0001773 A1 Jan. 6, 2005

(51) Int. Cl.[7] ..... H01Q 1/24
(52) U.S. Cl. ..... 343/702; 343/767; 343/906
(58) Field of Search ..... 343/702, 767, 343/906; 455/89, 90.3

(56) References Cited

U.S. PATENT DOCUMENTS 5,995,052 A * 11/1999 Sadler et al. ..... 343/702
6,011,519 A * 1/2000 Sadler et al. ..... 343/742
6,246,374 B1 * 6/2001 Perrotta et al. ..... 343/702
6,600,450 B1 * 7/2003 Efanov et al. ..... 343/726
6,636,181 B2 * 10/2003 Asano et al. ..... 343/702
6,806,835 B2 * 10/2004 Iwai et al. ..... 343/702

* cited by examiner

*Primary Examiner*—Tan Ho
(74) *Attorney, Agent, or Firm*—Ranal L. Karpinia

(57) ABSTRACT

An antenna system (300) for a communication device (100) includes an auxiliary antenna (140) and a printed circuit board (130). The auxiliary antenna (140) is located within a movable flip housing (110) of the communication device (100). The auxiliary antenna (140) has a structure comprising an electromagnetic radiator and a coupling probe (315). The printed circuit board (130) is located within a main housing (105) of the communication device (100). The coupling probe (315) couples the auxiliary antenna (140) to the printed circuit board (130).

20 Claims, 8 Drawing Sheets

ANTENNA SYSTEM FOR A COMMUNICATION DEVICE

BACKGROUND OF THE INVENTION

1. Field of the Invention

The present invention is related to an electromagnetic radiator and coupling probe, and more particularly to an electromagnetic radiator and coupling probe adapted to operate integrally with the antenna of a communication device.

2. Description of the Related Art

Communication devices, such as radiotelephones, are being driven by the marketplace towards smaller and smaller sizes. Consumer and user demand has continued to push a dramatic reduction in the size of communication devices. To create a more compact package, many communication devices in use today have incorporated as part of the overall communication device a flip assembly (also known as a clamshell assembly). A flip assembly typically consists of two or more housing portions that can each have, and/or contain printed circuit boards (PCBs) with electronic components, audio devices, camera's, visual displays, metal shields and metal chassis, as well as wiring to connect the electrical component together to form electrical circuits, and the like. In some communication devices, one housing portion is a hinged cover that closes to make the communication device more compact and to protect a keypad or other user interface located on a second housing portion from inadvertent entries. Typically, one housing rotates relative to the other housing in a plane perpendicular to the plane of the other housing.

As an example, a communication device such as a radiotelephone can comprise two planar elements coupled by a hinge. When the radiotelephone is not in use, the two planar elements are closed and lie in parallel. When the radiotelephone is in use, the two planar elements are opened in relation to each other, exposing such elements as a touch pad, viewing screen, microphone and/or speaker.

The antenna elements utilized for communication typically are located in one of the housing portions. One problem that arises is that when large metal objects such as the display shield are near the antenna radiating elements, the antenna elements can become detuned from the frequency of interest or shielded, and the effect is that the overall flip phone radiating efficiency can decrease. This negative effect can occur, for example, when the device flip assembly is in the open position. In most communication devices, the open position is the one typically utilized for communication as described previously. Thus, it is desirable for the transmit and receive performance when the flip is open to be at least equivalent to the performance when the flip is closed so that when a user opens the flip, the active communication is not degraded or terminated.

BRIEF DESCRIPTION OF THE DRAWINGS

The accompanying figures, where like reference numerals refer to identical or functionally similar elements throughout the separate views and which together with the detailed description below, are incorporated in and form part of the specification, serve to further illustrate various embodiments and to explain various principles and advantages all in accordance with the present invention.

DETAILED DESCRIPTION OF THE PREFERRED EMBODIMENT(S)

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms a or an, as used herein, are defined as one or more than one. The term plurality, as used herein, is defined as two or more than two. The term another, as used herein, is defined as at least a second or more. The terms including and/or, having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The present invention provides a system for improving the radiated efficiency of an antenna system integrated into a flip assembly type communication device. The present invention comprises the use of an integrated electromagnetic radiator and coupling probe to transfer radio frequency (RF) energy to and from an antenna element and a communication transceiver.

The present invention provides a system comprising the use of the flip chassis or flip PCB of a communication device as an efficient antenna radiator. The present invention specifically provides a system capable of transferring RF energy directly to the flip assembly chassis in an efficient manner without the use of wires or direct connections, by utilizing electromagnetic and/or inductive coupling of tuned resonant probe(s) that are attached to and/or part of the flip assembly.

Figure 1:
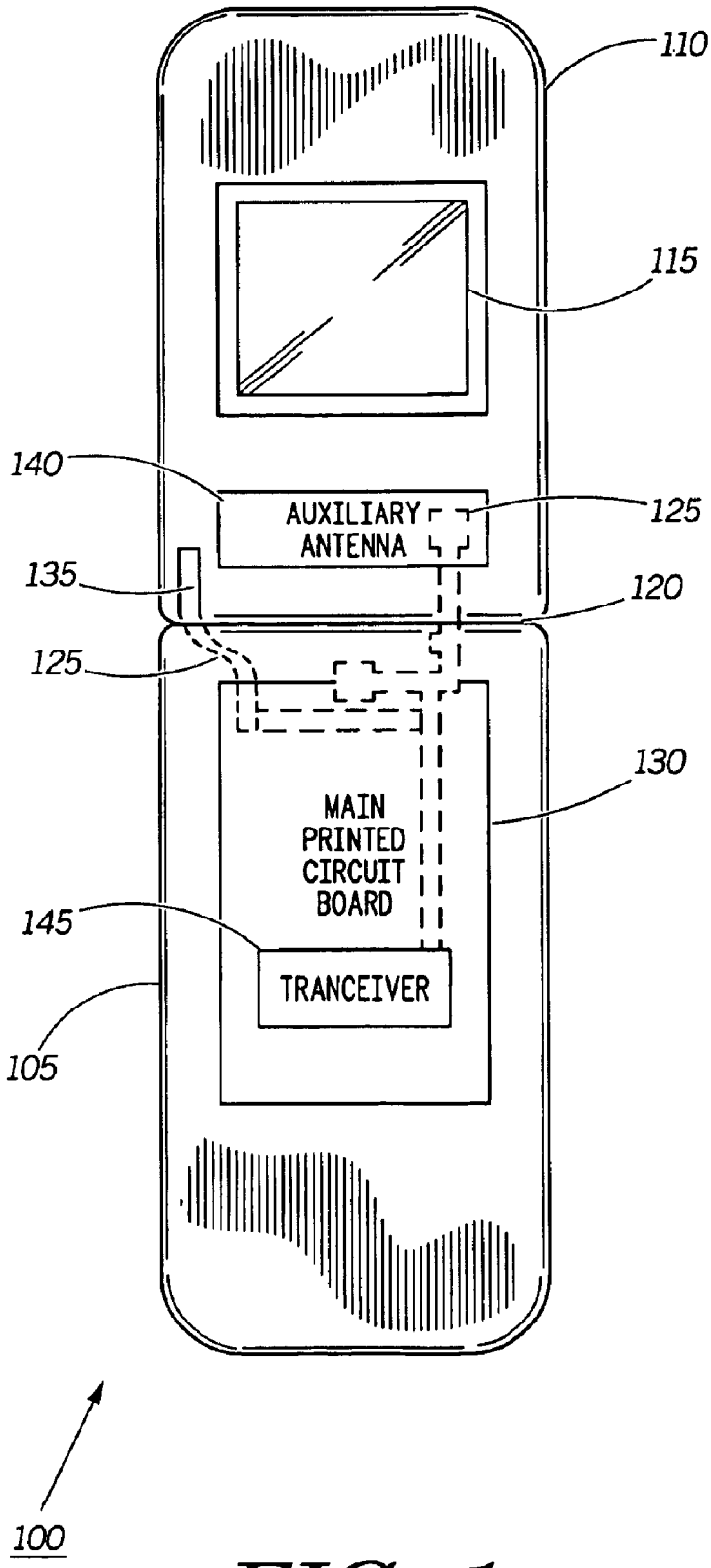
FIG. 1 illustrates one embodiment of a communication device.

Referring to FIG. 1, a physical embodiment of a communication device 100 such as a radiotelephone is shown. The communication device includes a main housing 105 and a movable flip housing 110, although these distinctions can be reversed without affecting the invention. The movable flip housing 110 has an open position (as shown) being hinged away from the main housing 105 and a closed position being in proximity to the main housing 105.

The communication device 100 can include a user interface that includes one or more of a display 115, and a microphone, keypad, and speaker (all not shown) as are known in the art. A hinge assembly 120 mechanically connects the main housing 105 and the movable flip housing 110. One or more interconnections 125 connect circuitry, such as circuit boards or circuit modules, between the main housing 105 and the movable flip housing 110. It will be appreciated by those of ordinary skill in the art that the interconnections 125 can be one or a combination of wires, coaxial cables, flexible cables, and the like. The interconnects 125, for example, can utilize flexible cables through the hinge assembly 120 for circuit signaling and power distribution between the adjacent communication device sub-assemblies including the main housing 105 and the movable flip housing 110.

As illustrated, the communication device 100 includes a main printed circuit board (PCB) 130 located within the main housing 105. The main PCB 130, for example, can provide electrical connections for a transceiver 145 to an antenna 135. It will be appreciated by those of ordinary skill in the art that the transceiver 145 includes a receiver or transceiver circuitry disposed therein and can be contained within the main housing 105 or optionally the movable flip housing 110. Along with providing a mounting surface and electronic connections for the various electronics required to operate the communication device 100, the main PCB 130 can function as part of an antenna radiating structure. The communication device 100 further includes an antenna 135 which can be located internally or externally (as illustrated) to the main housing 105. In practice, the antenna is coupled and matched to the circuitry of an electronic device as is known in the art. In a preferred embodiment of the present invention, an auxiliary antenna 140 is contained within the movable flip housing 110. The auxiliary antenna 140 preferably is coupled to the transceiver 145 and the antenna 135 via the one or more interconnections 125.

Figure 2:
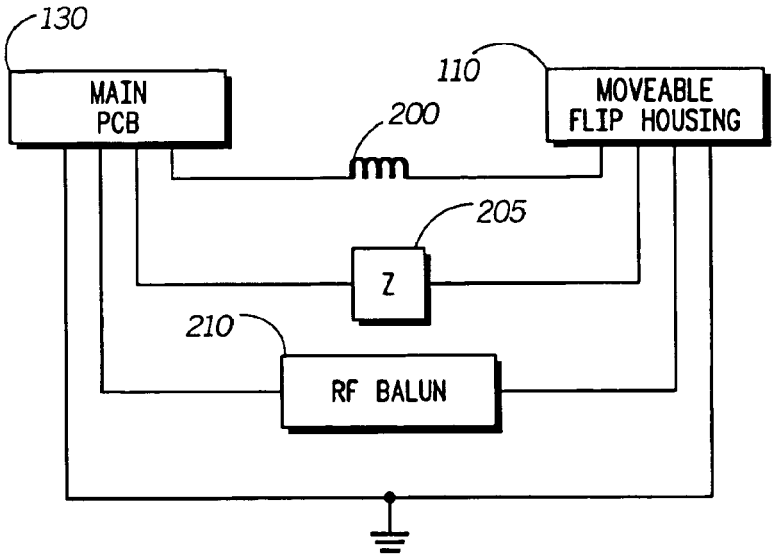
FIG. 2 illustrates various alternatives for electrical connections within the communication device of FIG. 1.

It will be appreciated by those of ordinary skill in the art, that acceptable performance of the communication device 100 requires decoupling of the main PCB 130 from the movable flip housing 110. FIG. 2 illustrates various alternatives for electrically accomplishing decoupling, when decoupling is required. As illustrated, decoupling can be accomplished using one or more of a combination of RF chokes 200, impedances (Z) 205, and/or RF baluns 210 in series and/or in parallel with the connecting wires.

It is common practice in RF design to transfer RF signals from one part of a circuit to another by the use of coupled transmission lines. The transmission lines are usually near a multiple of a quarter wavelength in length to obtain maximum power transfer at the frequency of interest, and the transmission line thickness, diameter, width and spacing and overlap are adjusted to obtain the desired coefficient of coupling between the lines. Usually this arrangement is for the purpose of creating a desired RF filter transfer function.

Figure 3:
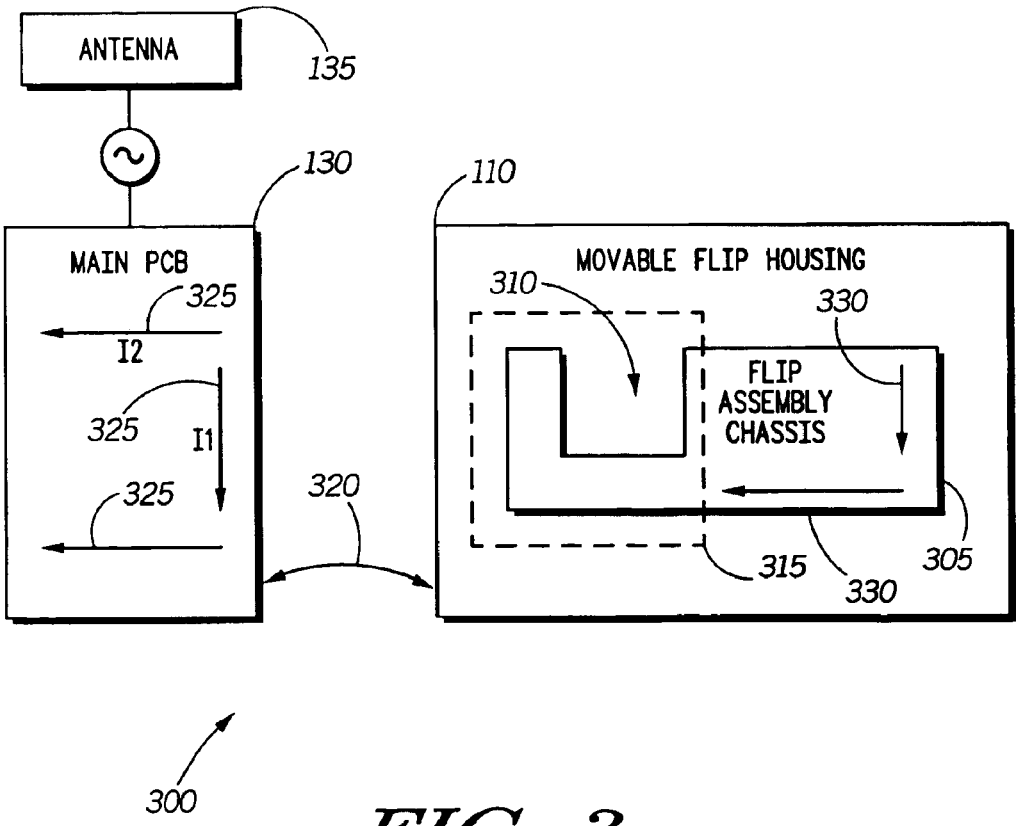
FIG. 3 is an electronic block diagram of an antenna system for use within the communication device of FIG. 1.

The present invention uses the concept of coupled lines to transfer RF energy from the main PCB 130 to the movable flip housing 110. Referring to FIG. 3, an antenna system 300, in accordance with a preferred embodiment of the present invention, is shown. As illustrated, a flip assembly chassis 305 (i.e. the auxiliary antenna 140 of FIG. 1) contained within the movable flip housing 110 is constructed with a slot 310 in its structure that effectively creates a coupling probe (transmission line) 315 as part of its structure. A transmission line is an electrical device that has inductance, capacitance, and resistance per unit length.

By integrating the coupling probe 315 within the flip assembly chassis 305, the flip assembly chassis 305 can be electro-magnetically excited as a radiator in an efficient manner by using tuned proximity coupling such as a coupling 320 illustrated in FIG. 3. One or more probe dimensions such as a probe width, a probe diameter, a probe length spacing, and an overlap can be adjusted for the desired coefficient of coupling between one or more currents 325 within the main PCB 130 and the movable flip assembly 105. One or more currents in the coupling probe 315 being used as a coupling device to the main PCB 130 for the efficient transfer of RF energy. Further one or more currents 325 in the main PCB 130 can radiate into free space.

According to the present invention, the coupling probe 315 and the overlapping or adjacent PCB constitute a pair of coupled lines. The part of the PCB board that does not have a physically visual probe or transmission line constitutes one line, of a pair of coupled lines, and is in fact one half of a pair of couples lines and is a virtual coupled line by virtue of the overlapping of the probe and the contiguous unslotted main PCB 130.

In accordance with a preferred embodiment of the present invention, the coupling probe 315 is located within the movable flip housing 110. When the movable flip housing 110 is in the closed position in relation to the main housing 105, the coupling probe 315 is a distance farther away from the main PCB 130 than it would otherwise be when the movable flip housing 110 is in the open position. Opening and closing of the movable flip housing 110 will vary the relative position between the coupling probe 315 and the virtual line and/or currents 325 on the main PCB 130 thereby varying the coefficient of coupling between the two coupled subsections of the communication device 100. As a result the radiation efficiency of the communication device 100 will vary with the rotational angle of the movable flip housing 110 in relation to the main housing 105.

Figure 4:
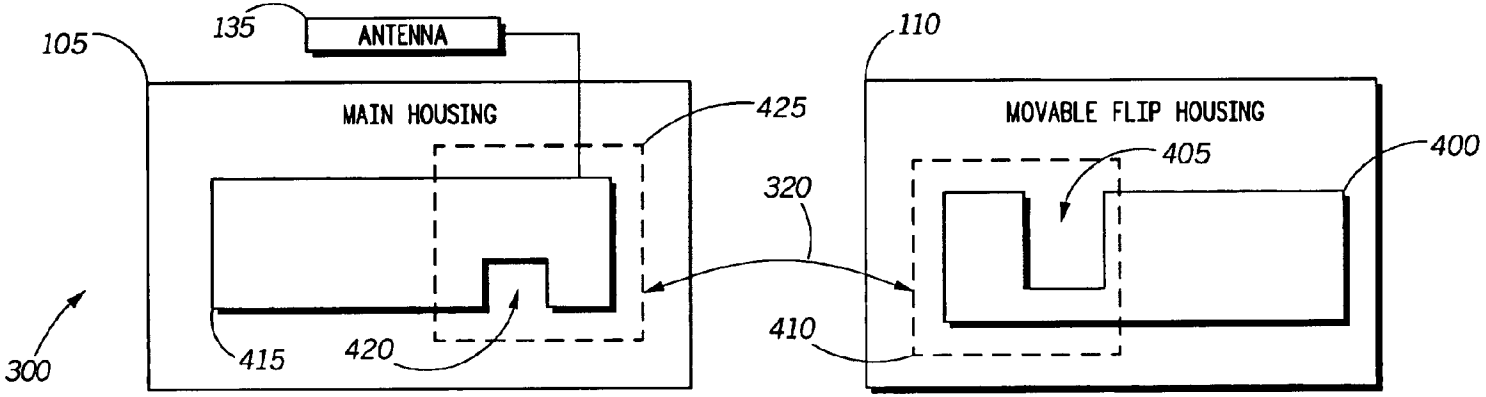
FIGS. 4 though 9 illustrate various structural embodiments of the antenna system of FIG. 3.

FIGS. 4 though 9 illustrate various structural embodiments of the antenna system 300 of FIG. 3 in accordance with the present invention. In accordance with the present invention, the antenna system 300 can be structurally located within the main housing 105, the movable flip housing 110, or a combination of both. It will be appreciated by those of ordinary skill in the art that one or more portions of the antenna system 300 can further be located within the hinge assembly 120 (not shown). It will be further appreciated by those of ordinary skill in the art that the antenna 135 can be connected to the main PCB 130 within the main housing 105, or alternatively can be connected to a PCB and/or auxiliary antenna within the movable flip assembly 110 (not shown).

FIG. 4 illustrates the antenna system 300 comprising the antenna 135, an upward slotted auxiliary antenna 400, and a downward slotted main PCB 415. The upward slotted auxiliary antenna 400 is contained within the movable flip housing 110. Similarly to the flip assembly chassis 305 described herein for FIG. 3, the upward slotted auxiliary antenna 400 is constructed with an upward slot 405 in its structure that effectively creates a first coupling probe 410 as part of its structure. Further, the downward slotted main PCB 415 is contained within the main housing. 105 and is coupled to the antenna 135. The downward slotted main PCB 415 is constructed with a downward slot 420 in its structure that effectively creates a second coupling probe 425 as part of its structure. The first coupling probe 410 and the second coupling probe 425 cause the coupling 320 as described previously herein for FIG. 3. It will be appreciated by those of ordinary skill in the art that the coupling 320 can include overlap coupling (not shown). It will be further appreciated by those of ordinary skill in the art that it is not necessary for the filter elements to overlap, for there to be a coefficient of coupling value that is non zero.

Figure 5:
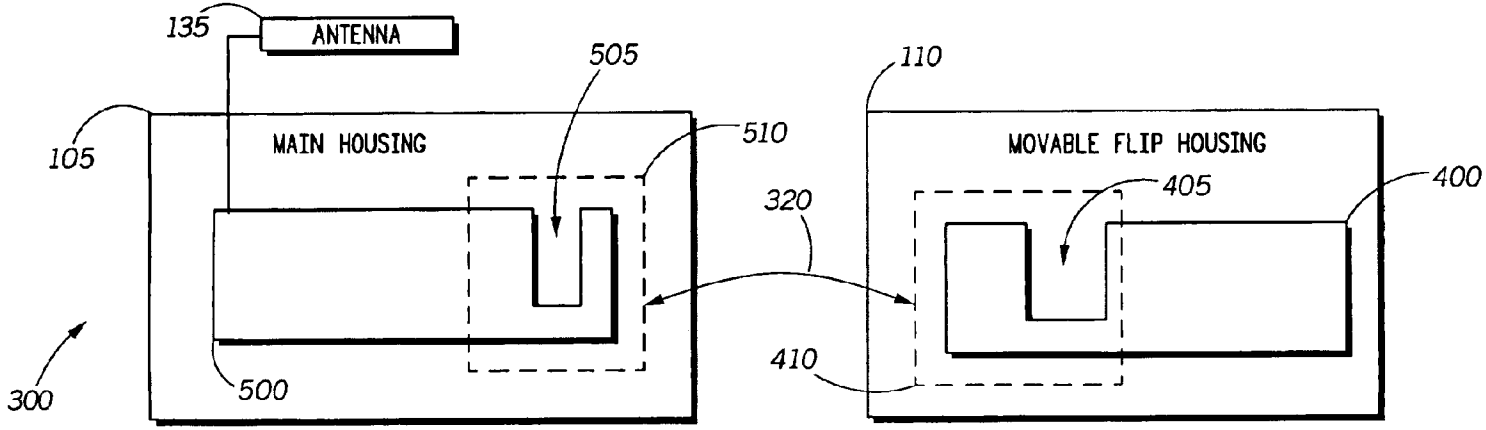

FIG. 5 illustrates the antenna system 300 comprising the antenna 135, the upward slotted auxiliary antenna 400, and an upward slotted main PCB 500. The upward slotted auxiliary antenna 400 is contained within the movable flip housing 110. Similarly to the flip assembly chassis 305 described herein for FIGS. 3 and 4, the upward slotted auxiliary antenna 400 is constructed with an upward slot 405 in its structure that effectively creates a first coupling probe 410 as part of its structure. Further, the upward slotted main PCB 500 is contained within the main housing 105 and coupled to the antenna 135. The upward slotted main PCB 500 is constructed with an upward slot 505 in its structure that effectively creates a second coupling probe 510 as part of its structure. The first coupling probe 410 and the second coupling probe 510 cause the coupling 320 as described previously herein. It will be appreciated by those of ordinary skill in the art that the coupling 320 can include overlap coupling (not shown). It will be further appreciated by those of ordinary skill in the art that it is not necessary for the filter elements to overlap, for there to be a coefficient of coupling value that is non zero.

Figure 6:
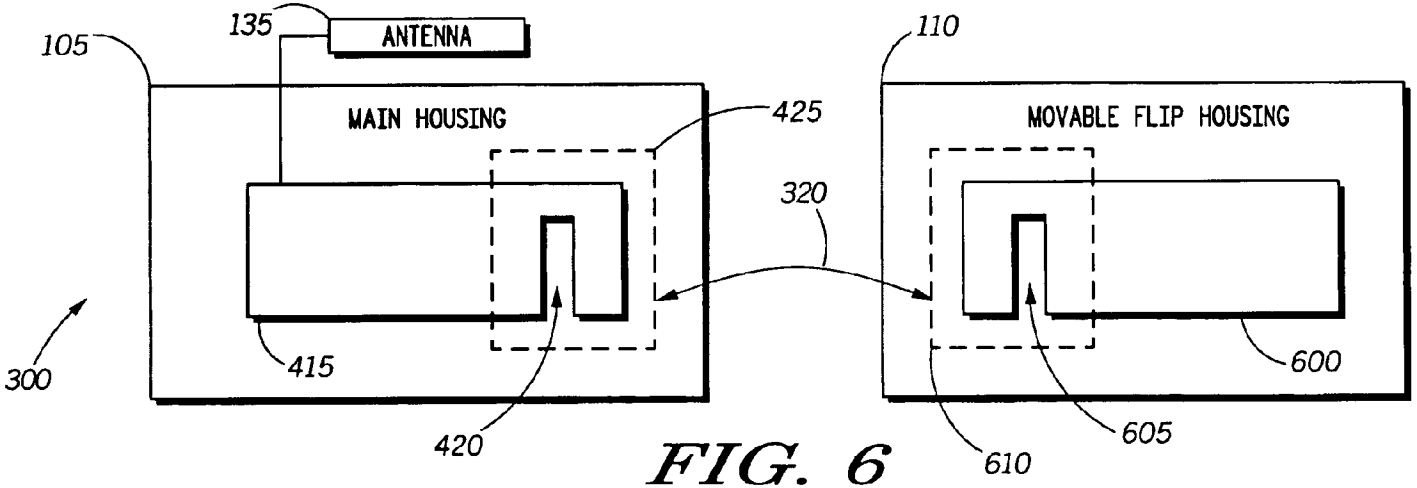

FIG. 6 illustrates the antenna system 300 comprising the antenna 135, a downward slotted auxiliary antenna 600, and the downward slotted main PCB 41S. The downward slotted auxiliary antenna 600 is contained within the movable flip housing 110. Similarly to the flip assembly chassis 305 described previously herein, the downward slotted auxiliary antenna 600 is constructed with a downward slot 605 in its structure that effectively creates a first coupling probe 610 as part of its structure. Further, the downward slotted main PCB 415 is contained within the main housing 105 and coupled to the antenna 135. The downward slotted main PCB 415 is constructed with a downward slot 420 in its structure that effectively creates a second coupling probe 424 as part of its structure. The first coupling probe 610 and the second coupling probe 420 cause the coupling 320 as described previously herein. It will be appreciated by those of ordinary skill in the art that the coupling 320 can include overlap coupling (not shown). It will be further appreciated by those of ordinary skill in the art that it is not necessary for the filter elements to overlap, for there to be a coefficient of coupling value that is non zero.

Figure 7:
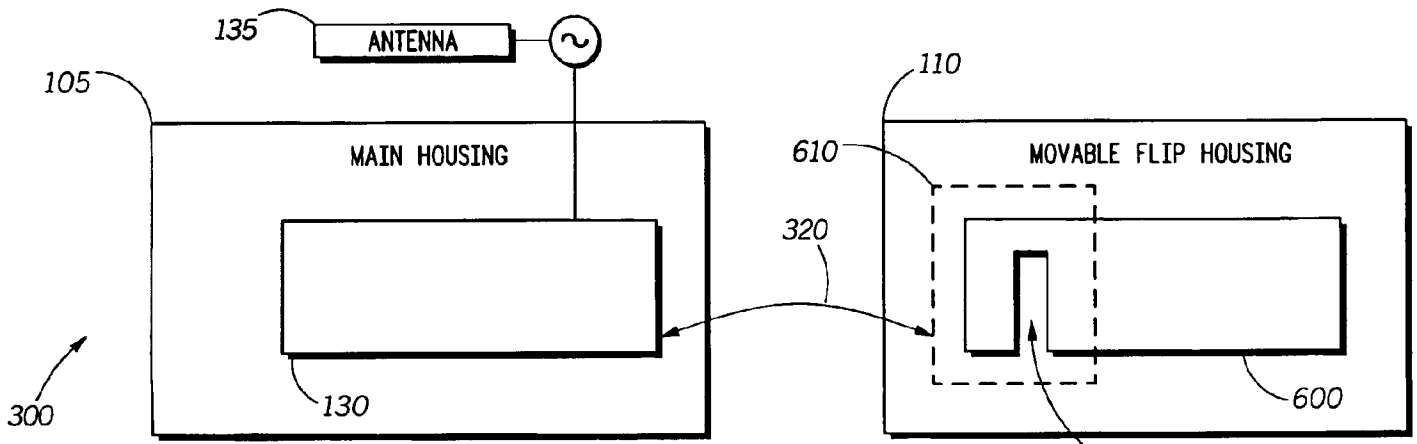

FIG. 7 illustrates the antenna system 300 comprising the antenna 135, the main PCB 130, and the downward slotted auxiliary antenna 600. The downward slotted auxiliary antenna 600 is contained within the movable flip housing 110. Similarly to the flip assembly chassis 305 described previously herein, the downward slotted auxiliary antenna 600 is constructed with a downward slot 605 in its structure that effectively creates a first coupling probe 610 as part of its structure. Further, the main PCB 130 is contained within the main housing 105 and coupled to the antenna 135. The first coupling probe 610 couples to the main PCB 130 creating the coupling 320 as described previously herein. It will be appreciated by those of ordinary skill in the art that the coupling 320 can include overlap coupling (not shown). It will be further appreciated by those of ordinary skill in the art that it is not necessary for the filter elements to overlap, for there to be a coefficient of coupling value that is non zero.

Figure 8:
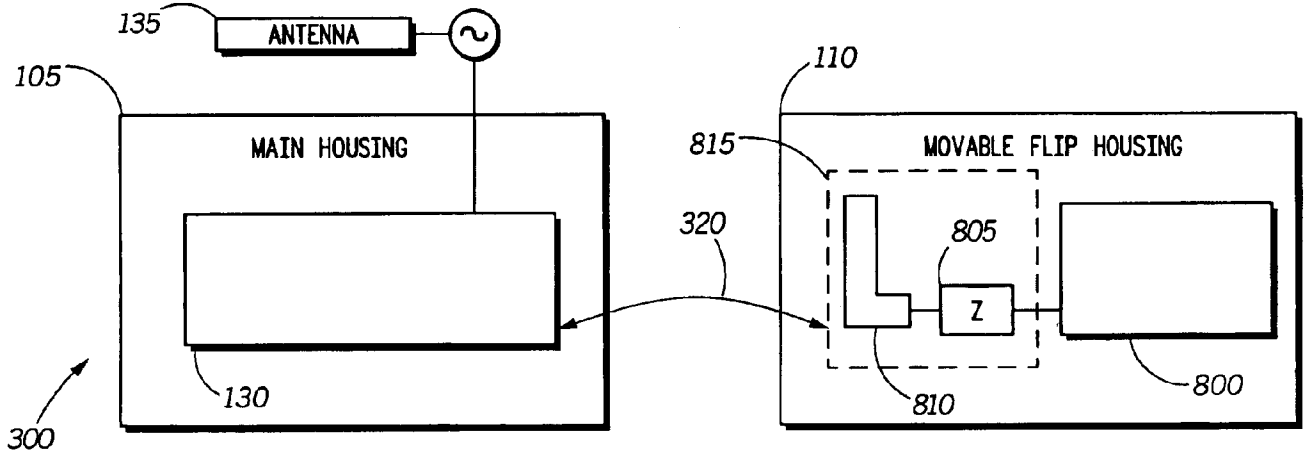

FIG. 8 illustrates the antenna system 300 comprising the antenna 135, the main PCB 130, and an impedance coupling auxiliary antenna 800. The impedance coupling auxiliary antenna 800 is contained within the movable flip housing 110. The impedance coupling auxiliary antenna 800 is constructed with an impedance 805 coupled between a flip assembly PCB 800 and a conductive element 810 effectively creating a coupling probe 815 as part of its structure. Further, the main PCB 130 is contained within the main housing 105 and coupled to the antenna 135. The coupling probe 815 couples to the main PCB 130 creating the coupling 320 as described previously herein. It will be appreciated by those of ordinary skill in the art that the coupling 320 can include overlap coupling (not shown). It will be further appreciated by those of ordinary skill in the art that it is not necessary for the filter elements to overlap, for there to be a coefficient of coupling value that is non zero.

Figure 9:
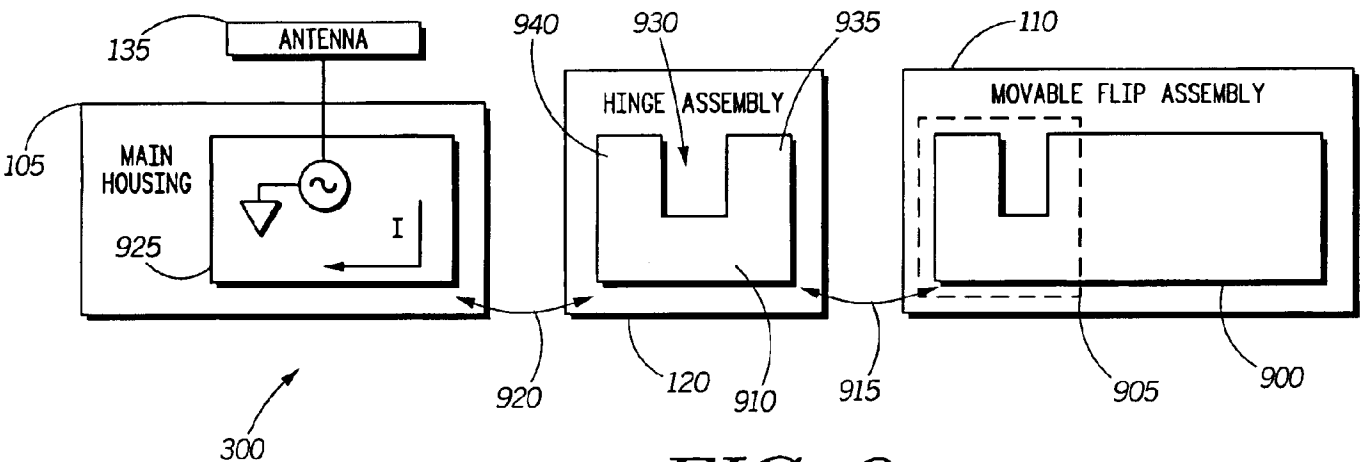

It will be appreciated by those of ordinary skill in the art that more than two coupled lines can be used to couple energy from the main PCB 130 to the movable flip assembly 110. FIG. 9 illustrates the antenna system 300 comprising the antenna 135, a PCB 925, a first portion auxiliary antenna 900, and a second portion auxiliary antenna 910. The first portion auxiliary antenna 900 is contained within the movable flip housing 110. It will be appreciated by those of ordinary skill in the art that the first portion auxiliary antenna 900 can be constructed using any of the designs described in FIGS. 4 through 8 herein. For example, the first portion auxiliary antenna 900 can be the upward slotted auxiliary antenna 400, the downward slotted auxiliary antenna 600, the impedance coupling auxiliary antenna 800, or the like. The PCB 925 is contained within the main housing 105 and coupled to the antenna 135. It will be appreciated by those of ordinary skill in the art that the PCB 925 can be constructed using any of the designs described in FIGS. 4 through 8 herein. For example, the PCB 925 can be the main PCB 130, the downward slotted main PCB 415, the upward slotted main PCB 500, or the like. Coupled between the PCB 925 and the first portion auxiliary antenna 900 is the second portion auxiliary antenna 910. The second portion auxiliary antenna 910, for example, is constructed with at least one slot 930 structured between a first conductive element 935 and a second conductive element 940 to form one or more conductive probes. The first conductive element 935 and a first coupling probe 905, for example, can form a first coupling 915 between the first auxiliary antenna portion 900 and the second auxiliary antenna portion 910. Similarly, the second conductive element 940 and the PCB 925 can form a second coupling 920 between the second auxiliary antenna portion 910 and the PCB 925. It will be appreciated by those of ordinary skill in the art that the first coupling 915 and the second coupling 920 can include overlap coupling (not shown). It will be appreciated by those of ordinary skill in the art that for all antenna systems 300 described for FIGS. 4 through 9 herein; modern filter theory applies and when the coupling between the resonators adjusted properly various filter transfer functions can be accomplished.

It will be appreciated by those of ordinary skill in the art that the shape of the coupling probe does not have to be an "L" or a "U" as shown in FIGS. 3 through 9 herein, but can be any pattern that fits in the space provide and provides the necessary coefficient of coupling and probe resonant frequency. It will be further appreciated by those of ordinary skill in the art that it is not necessary for the filter elements to overlap, for there to be a coefficient of coupling value that is non zero.

Figure 10:
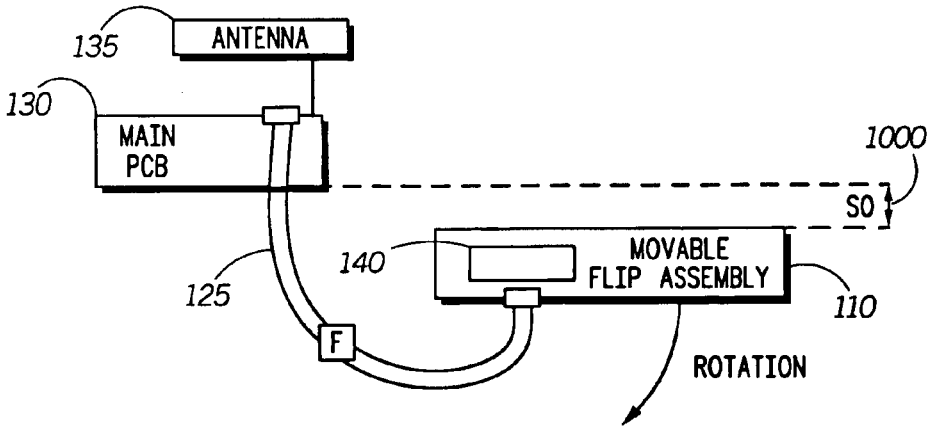
FIGS. 10 and 11 illustrate exemplary embodiments of interconnections for use within the communication device of FIG. 1.
Figure 11:
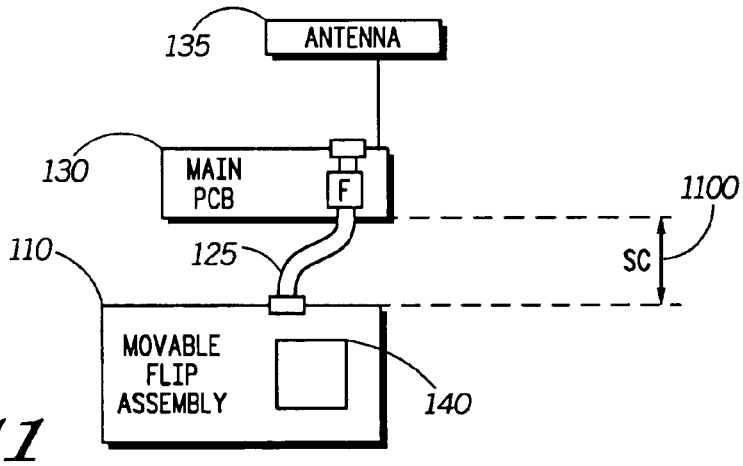

As described previously in relation to FIG. 1, one or more interconnections 125 connect circuitry, such as circuit boards or circuit modules, between the main housing 105 and the movable flip housing 110. FIGS. 10 and 11 illustrate two exemplary embodiments of the one or more interconnections 125 in accordance with the present invention. It will be appreciated by those of ordinary skill in the art that within the communication device 100, the one or more interconnections 125 can be placed in the proximity of the one or more coupling probes described previously in FIGS. 3 through 9 and can be included as part of the coupled line structure. It will be appreciated by those of ordinary skill in the art that RF chokes, resistors, capacitors, and inductors can be placed in series or in parallel with the interconnecting wiring between the main board and the flip assembly in order to control the impedance and/or coupling factor of the interconnecting wiring. The coupling probes and/or loops can further be used as impedance matching components as well as coupling devices.

FIG. 10 is a side view of the internal structure of the communication device 100 in accordance with the present invention. Specifically, FIG. 10 illustrates the internal structure of the communication device 100 when the movable flip assembly 110 is in the open position. FIG. 10 shows the relative position of the auxiliary antenna 140 including the coupling probe, the interconnections 125, and the coupled line (virtual line) on the main PCB 130 when the movable flip assembly 110 is open. As illustrated, the distance between the main PCB 130 and the movable flip assembly 110 in the open position is designated by an open position distance 1000.

FIG. 11 is a side view of the internal structure of the communication device 100 in accordance with the present invention. Specifically, FIG. 11 illustrates the internal structure of the communication device 100 when the movable flip assembly 110 is in the closed position. FIG. 11 shows the relative position of the auxiliary antenna 140 including the coupling probe, the interconnections 125, and the coupled line (virtual line) on the main PCB 130 when the movable flip assembly 10 is closed. As illustrated, the distance between the main PCB 130 and the movable flip assembly 110 in the closed position is designated by a closed position distance 100.

Note that in a communication device with this arrangement of main board, cabling, coupling and flip chassis, that the relative spacing and orientation of the probe and the main board resonator change as the flip is opened and closed. In other words, the open position distance 1000 and the closed position distance 100 are different. Also the positions of the coupling probe and the interconnections 125 relative to the main PCB 130 are interchanged when the movable flip assembly 110 is opened and closed.

In this case, the physical position of the FPR (Flip Probe Resonator) and the CR (Cable Resonator) reverse position in the coupled structure that constitutes an filter with multiple resonators. Designating the open position distance 1000 as SO and the closed position distance 100 as SC, it is noted that SO<SC.

S varies with the flip rotation angle (S=main board/flip chassis spacing).

The coefficient of coupling between the filter resonator elements will vary with the flip rotation angle. As a result the transfer function of the filter will change depending on the flip rotational angle, and this can cause the efficiency of the communication device antenna system to vary with the flip angle. Preferably, interconnection flex cables are fed thru the hinge assembly 120 to interconnect the main PCB 130 and the movable flip assembly 110. The flex cable and the virtual resonator in the ground structure of the main PCB 130 can constitute an N pole filter, depending the number of layers in the flex cable. The addition of the resonant probe creates an additional filter pole.

Figure 12:
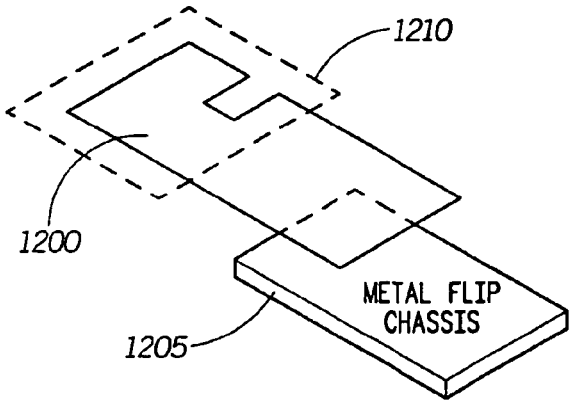
FIG. 12 illustrates one embodiment of the construction of a portion of the antenna system of FIGS. 3 through 9.

FIG. 12 illustrates one embodiment of the construction of a portion of the antenna system of FIGS. 3 through 9. Specifically, FIG. 12 illustrates a preferred construction of a coupling probe 1210 in accordance with the present invention. Preferably, the construction of the coupling probe 1210 comprises a piece of copper tape 1200 attached to the metal flip chassis 1205 as illustrated. This allows the coupling probe 1210 to wrap around the plastic hinge assembly of the communication device 100. The hinge assembly 120 must rotate to perform its function. The use of peel and stick copper tape (or other metal tape) allows the diameter of the hinge mechanism to be smaller than if the coupling probe 1210 was an extension of the metal that makes up the metal flip assembly 1205.

It will be appreciated by those of ordinary skill in the art that the coupling probe 1210 can be integral part of the chassis shield or other metal component of the flip assembly 110. When metalized peel and stick tape is used to fabricate and attach the coupling probe 1210 the adhesive tape used can be of the non-conducting type since there will be a parallel plate capacitance between the metal tape and the metal flip chassis. In this case the capacitance functions as a DC block and RF matching component. It will be also appreciated by those of ordinary skill in the art that metal tape with conductive adhesive can be used when a DC block function is not need, or when and/or when RF matching is not needed.

Figure 13:
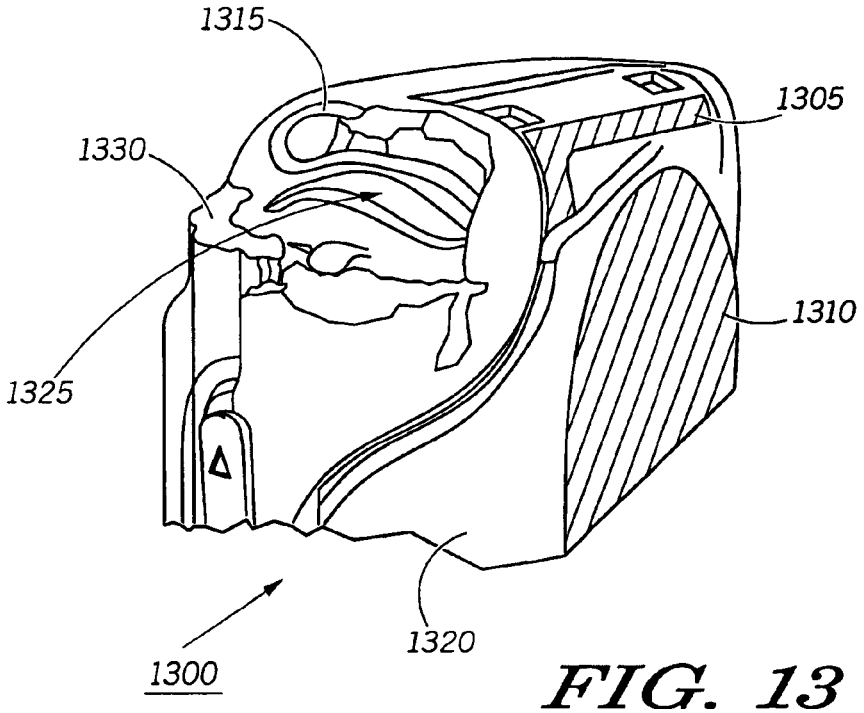
FIGS. 13 through 15 illustrate various embodiments of the construction of the communication device of FIG. 1.
Figure 14:
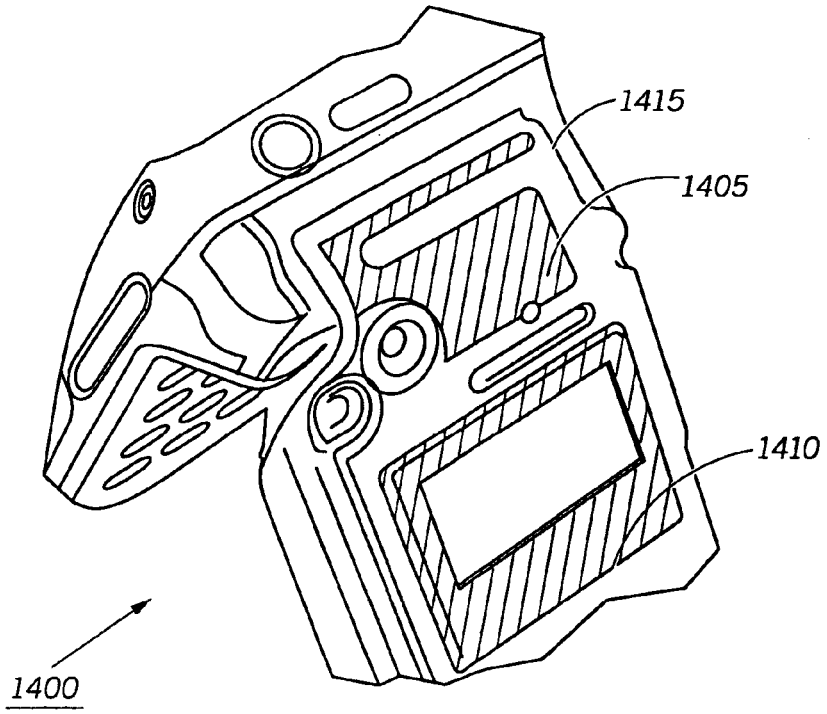
Figure 15:
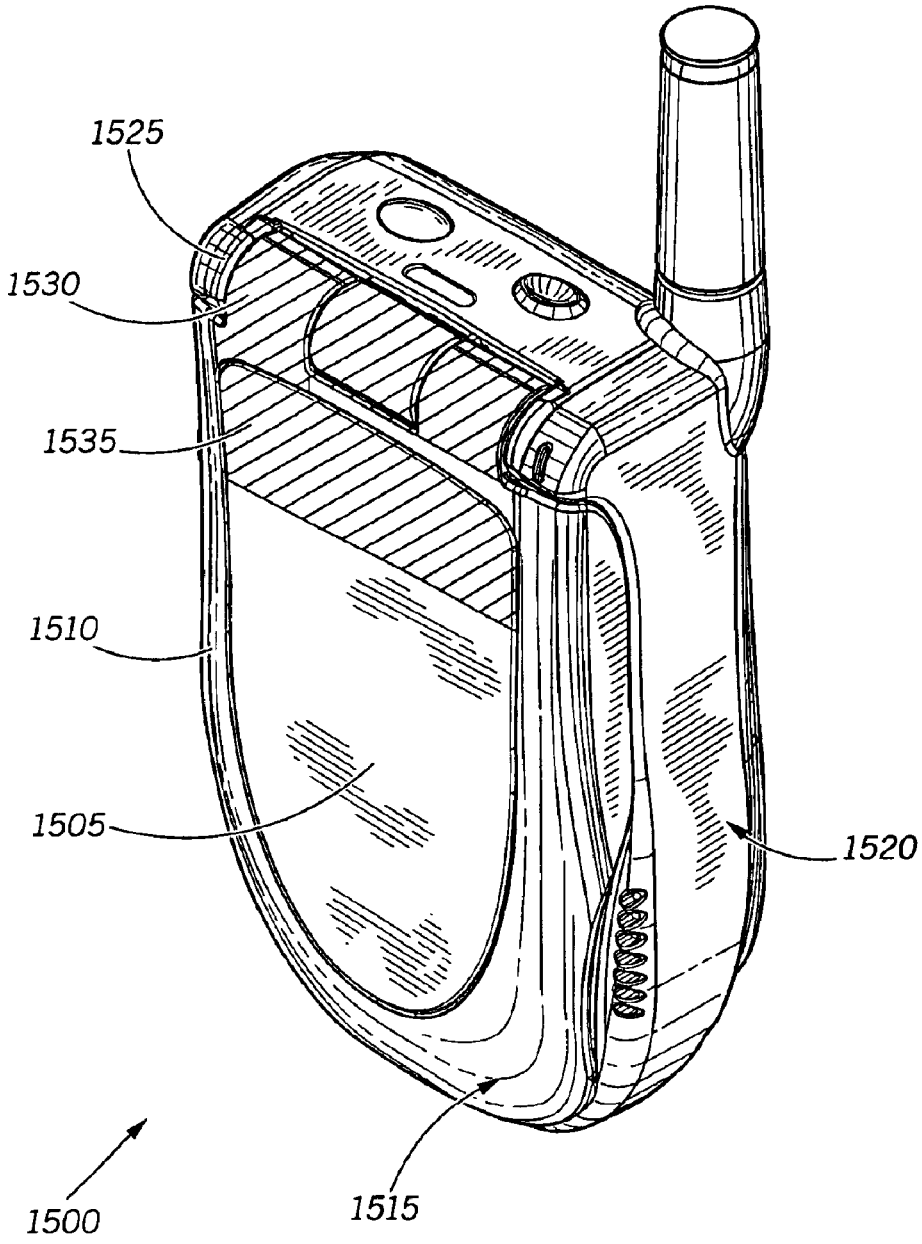

FIGS. 13 through 15 illustrate various embodiments of the construction of the communication device of FIG. 1 in accordance with the present invention. FIG. 13 illustrates a portion of a radiotelephone chassis 1300 when the radiotelephone chassis 1300 is in the closed position. As illustrated, an electromagnetic radiator and coupling probe 1305 is constructed of metalized tape and attached to a hinge mechanism 1325 which causes the electromagnetic radiator and coupling probe 1305 to rotate in relation to a front housing 1320. In the exemplary embodiment of FIG. 13, the front housing 1320 includes a metalized ground shield 1310 to which the electromagnetic radiator and coupling probe 1305 couples to as described previously. An interconnection wire 1315 provides connection between the electronics in the front housing and the electronics in a rear housing 1330 as previously described. The interconnection wire 1315 can create a BALUN to decrease, or control the amplitude of the RF currents flowing in the flex cable layers and can be used to control the coefficient of coupling between the elements of the filter. It will be appreciated that the interconnection wire 1315 can be replaced by a flex circuit or any metal fabricating method.

FIG. 14 illustrates a portion of a radiotelephone chassis 1400 when the radiotelephone chassis 1400 is in the open position. As illustrated, an electromagnetic radiator and coupling probe 1405 is constructed of metalized tape and attached to a metalized shield 1410 as well as a hinge mechanism 1415 which causes the electromagnetic radiator and coupling probe 1405 to rotate in relation to the metalized shield 1410.

FIG. 15 illustrates an alternative embodiment of the construction of the electromagnetic radiator and coupling probe integrated within a communication device in accordance with the present invention. As illustrated in FIG. 15, a radiotelephone 1500 comprises a rear housing assembly

1520, a front housing assembly 1515, and a rotating hinge assembly 1525 for connecting the rear housing assembly 1520 to the front housing assembly 1515. Typically, the front housing assembly 1515, the rear housing assembly 1520, and the rotating hinge assembly 1525 are molded out of plastic materials. The front housing assembly 1515 can, as illustrated, include a non metallic decorative lens 1505 and a metal display shield 1510, along with other electronics and mechanics required for the operation of the radiotelephone 1500. In accordance with the present invention, an electromagnetic radiator and coupling probe 1535 is comprised of conductive paint or tape as desired. In the exemplary embodiment of FIG. 15, the electromagnetic radiator and coupling probe 1535 is constructed by adhering metallization directly onto the plastic portions of the rotating hinge assembly 1525. Alternatively, the required metallization can be added to the non metallic decorative lens 1505 that can be snapped over the rotating hinge assembly 1525. A connection from a tuned coupling probe 1530 (structured within the electromagnetic radiator and coupling probe 1535) to the metal display shield 1510 can be made by direct contact in which there is a DC (direct current). Alternatively, a connection from the tuned coupling probe 1530 to the metal display shield 1510 can be made by an RF connection. Alternatively an RF connection from the tuned coupling probe 1530 to the metal display shield 1510 can be made by an AC (alternate current) RF connection via reactive and/or capacitive coupling from the paint, tape, or other metallization. The tuned coupling probe 1530 preferably is tuned to work in conjunction with the metal display shield 1510, providing the coupling coefficient required for the transfer function desired.

Although the invention has been described in terms of a preferred embodiment, it will be appreciated that the integrated electromagnetic radiator and coupling probe can be constructed using other metallic objects within the communication device. For example, metal hinge axles can be used as part of the resonant structure and can also function as resonant filter poles and/or can be part of the metallic structure that create one filter resonant pole. Further, it will be appreciated that the resonators' physical lengths and the coefficient of coupling between the resonators are affected by the surrounding dielectric constant that is not equal to one because of the materials that are used to create the mechanical structure of the cellular phone. Further, it will be appreciated that one or more coupling probes can be placed on multiple communication device sub assemblies to increase the radiating efficiency of the antenna system. If more than two adjacent entities are to be coupled they can all have and/or incorporate coupling probes for the use of cross coupling between the sub-assemblies.

It will be appreciated by those of ordinary skill in the art that the rotating coupling probe on the hinge assembly can be used to transfer RF signals to the other components in a radiotelephone flip housing besides the chassis. If two or more transmission lines are coupled, then all of the coupled lines can have current following through them. If a quarter wave transmission line or a transmission line that has a length that is a multiple of a quarter wave length, is incorporated into a circuit that needs a so call quarter wave line, or a half wave line, all frequencies in the band of interest can not have a wavelength that is 4 times or 2 times, the length of the transmission line section.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An antenna system for a communication device, the antenna system comprising:

an auxiliary antenna within a movable flip housing of the communication device, wherein the auxiliary antenna has a structure comprising an electromagnetic radiator and a coupling probe; and a printed circuit board within a main housing of the communication device, wherein the coupling probe couples the auxiliary antenna to the printed circuit board.

2. An antenna system as recited in claim 1 further comprising:

an antenna coupled to the printed circuit board.

3. An antenna system as recited in claim 1 wherein the auxiliary antenna includes a slot to create the coupling probe.

4. An antenna system as recited in claim 1 wherein the auxiliary antenna comprises an electromagnetically excited radiator created by proximately coupling the coupling probe to the printed circuit board.

5. An antenna system as recited in claim 1 wherein the coupling probe of the auxiliary antenna includes one or more probe dimensions that are used to determine a desired coefficient of coupling between one or more currents within the printed circuit board and the auxiliary antenna, and further wherein the one or more probe dimensions are chosen from a group consisting of a probe width, a probe diameter, a probe length, a probe spacing and an overlap.

6. An antenna system as recited in claim 1 wherein one or more probe currents are present within the coupling probe, and further wherein the one or more probe currents radiate in response to the coupling between the coupling probe and the printed circuit board.

7. An antenna system as recited in claim 1 wherein one or more currents are present within the printed circuit board, and further wherein the one or more currents radiate in response to the coupling between the coupling probe and the printed circuit board.

8. An antenna system as recited in claim 1 wherein the coupling probe and the printed circuit board together comprise a pair of coupled lines.

9. An antenna system as recited in claim 1, wherein the movable flip housing rotates with respect to the main housing causing a relative position of the coupling probe and the printed circuit board to vary, and further wherein a coefficient of coupling between the coupling probe and the printed circuit board varies in response to the varying relative position.

10. An antenna system as recited in claim 9 wherein a radiation efficiency of the antenna system varies in response to the varying coefficient of coupling.

11. An antenna system as recited in claim 1, wherein the auxiliary antenna is an antenna selected from a group consisting of an upward slotted auxiliary antenna, a downward slotted auxiliary antenna, and an impedance coupling auxiliary antenna.

12. An antenna system as recited in claim 1, wherein the printed circuit board is a printed circuit board selected from a group consisting of a main printed circuit board, a downward slotted main printed circuit board, and an upward slotted main printed circuit board.

13. An antenna system for a communication device, the antenna system comprising:

an antenna;

a printed circuit board coupled to the antenna, wherein the printed circuit board is contained within a main housing of the communication device;

a first portion auxiliary antenna contained within a movable flip housing of the communication device; and a second portion auxiliary antenna coupled between the printed circuit board and the first portion auxiliary antenna.

14. An antenna system as recited in claim 13 wherein the second portion auxiliary antenna is contained within a hinge assembly of the communication device, wherein the hinge assembly couples together the movable flip housing and the main housing.

15. An antenna system as recited in claim 13 wherein the second portion auxiliary antenna includes at least one slot between a first conductive element and a second conductive element to form one or more conductive probes.

16. An antenna system as recited in claim 15 wherein the first conductive element and a first coupling probe form a first coupling between the first auxiliary antenna portion and the second auxiliary antenna portion.

17. An antenna system as recited in claim 15, wherein the second conductive element and the printed circuit board form a second coupling between the second auxiliary antenna portion and the printed circuit board.

18. An antenna system for use within a communication device having a front housing, a rear housing, and a rotating hinge assembly coupled between the front housing and the rear housing, the antenna system comprising:

an electromagnetic radiator and a coupling probe constructed by adhering metallization onto one or more plastic portions of the rotating hinge assembly.

19. An antenna system as recited in claim 18 further comprising:

a metal display shield constructed within the front housing; and a connection path between the coupling probe and the metal display shield, wherein the connection path is selected from a group consisting of a direct contact in which there is a DC (direct current), an RF connection, and an alternate current radio frequency connection.

20. An antenna system for use within a communication device having a front housing, a rear housing, and a rotating hinge assembly coupled between the front housing and the rear housing, the antenna system comprising:

an electromagnetic radiator and coupling probe constructed by adhering metallization onto a non metallic decorative lens; wherein the non metallic decorative lens is coupled to the rotating hinge assembly.

* * * * *